US007955567B2

(12) United States Patent
Matveev

(10) Patent No.: US 7,955,567 B2
(45) Date of Patent: Jun. 7, 2011

(54) TRIPLE HELICAL FLOW VORTEX REACTOR IMPROVEMENTS

(76) Inventor: Igor Matveev, McLean, VA (US)

( * ) Notice: Subject to any disclaimer, the term of this patent is extended or adjusted under 35 U.S.C. 154(b) by 955 days.

(21) Appl. No.: 11/843,942

(22) Filed: Aug. 23, 2007

(65) Prior Publication Data

US 2009/0050713 A1 Feb. 26, 2009

(51) Int. Cl.
*B01J 19/08* (2006.01)

(52) U.S. Cl. ..... 422/186; 422/224

(58) Field of Classification Search ..... 422/186, 422/224

See application file for complete search history.

(56) References Cited

U.S. PATENT DOCUMENTS 3,098,704 A * 7/1963 Schoppe ..... 423/659
5,024,684 A 6/1991 Tank
5,413,227 A 5/1995 Diebold et al.
6,187,206 B1 2/2001 Bernier et al.
6,380,268 B1 4/2002 Yakobson et al.
6,606,855 B1 8/2003 Kong
6,804,950 B2 10/2004 Kong
6,853,142 B2 2/2005 Chistyakov
6,924,608 B2 8/2005 Czernichowski et al.
6,976,362 B2 12/2005 Sheppard et al.
7,452,513 B2 * 11/2008 Matveev ..... 422/186
2006/0135630 A1 6/2006 Bowe

* cited by examiner

*Primary Examiner* — Kishor Mayekar
(74) *Attorney, Agent, or Firm* — Louis Ventre, Jr.

(57) ABSTRACT

Improvements to a triple helical flow vortex reactor add an inner wall (103) having at least one transition point (121) between the fuel inlet end (101) and the gas outlet end (102) and a circumferential flow apparatus (120) operating at each transition point (121). A restrictor at each transition point (121) is optionally added to reduce aerodynamic resistance to the various fluid flows. A vortex swirler is optionally added through the fuel inlet end, which preferably surrounds an inlet nozzle combined with a plasma torch. The fuel inlet end is optionally equipped with cooling channels in which a coolant can flow isolated from the reaction chamber. An optional coaxial cylindrical wall extends through the reaction chamber and creates a toroidal volume for reactions.

6 Claims, 6 Drawing Sheets

TRIPLE HELICAL FLOW VORTEX REACTOR IMPROVEMENTS

FIELD OF INVENTION

In the field of vortex flow field reaction motors, improvements to a reactor employing at least three helical flow vortexes in a reaction chamber in which a fuel is injected, mixed with an oxidizer and partially or fully consumed during a reforming or power production process.

BACKGROUND OF THE INVENTION

The invention comprises improvements to a triple helical flow vortex reactor first described in applicant's U.S. patent application Ser. No. 11/309,644 filed on Sep. 2, 2006, now U.S. Pat. No. 7,452,513, which is hereby incorporated by reference herein; and to a powerplant and method using a triple helical vortex reactor described in applicant's copending U.S. patent application Ser. No. 11/697,291 filed on Apr. 5, 2007, which is hereby incorporated by reference herein.

DESCRIPTION OF PRIOR ART

A triple helical flow vortex reactor according to the '644 and '291 applications has a reaction chamber with the means to create at least three fluid flow vortexes and an optional double end orbiting plasma arc to sustain combustion. The first vortex is of fuel and combusted gases such that said fuel and combusted gases spiral away from a fuel inlet end towards an exhaust nozzle or gas outlet end of the reaction chamber. The second vortex is one starting at the gas outlet end and confined to a thin layer at the inner wall surface of the reaction chamber. The second vortex spirals in a direction reverse to the flow of the first vortex towards the fuel inlet end of the reaction chamber. The third vortex is starting at the fuel inlet end and also confined to a thin layer at the inner wall surface of the reaction chamber in a direction with the flow of the first vortex. Thus, a triple helical flow vortex reactor employs one or more reverse vortexes, that is, a vortex reverse to the outward flow from the reaction chamber. A reverse vortex cools the walls, creates a shield for the reaction chamber wall and facilitates in the reactions.

While the existing art embodied by the pending '644 and '291 applications, noted above, is a substantial improvement over the prior art, further testing has shown that further improvements could be implemented to create a shorter reaction zone that would enable the creation of portable fuel reformers and other devices with rich mixture processing; provide higher efficiency in combustion using lean mixtures; and add simplicity and reliability of ignition and flame control in both lean and rich mixtures.

Improvements of the present invention: (1) add one or more circumferential reverse vortex swirlers at each step of a stepped inner wall of the reaction chamber; (2) add one or more smaller, direct vortex swirlers through the fuel inlet end; and (3) optionally combine an inlet nozzle with a plasma torch surrounded by a direct vortex swirler.

A stepped inner wall is configured to increase the reaction chamber volume at the fuel inlet end and decrease the volume at the gas outlet end. Such a configuration improves efficiency by reducing the velocity of reagents at the fuel inlet end in comparison to the velocity of reactants at the gas outlet end and increases the reagents residence time in the reaction chamber. A reagent is a chemical substance that is used to create a reaction in combination with some other substance. For purposes of this disclosure reagents are intended to be broadly defined to include air, water steam, any hydrocarbon fuel, additives, powders, gases and any other chemical supporting the desired reaction in the vortex reactor.

A circumferential reverse vortex swirler is added at each step in the wall, in part to provide an additional wall cooling mechanism and this is especially useful at the fuel inlet end where the temperature is higher because of heat transfer from combustion.

A direct vortex is created at the fuel inlet end by a direct vortex swirler. The direct vortex in turn establishes a recirculation zone at the fuel inlet end of the reaction chamber. A recirculation zone resembles a small O-ring in the reaction chamber. When multiple direct vortex swirlers are used, each such direct vortex created in the reaction chamber enables more thorough mixing of reagents, which is helpful to increase residence time, shorten the reactor length and increase reactor performance. The direct vortex swirlers may be used alone or preferably surrounding a combination reagent inlet nozzle and plasma torch.

The combination inlet nozzle and plasma torch surrounded by a direct vortex swirler is preferably applied when using liquid and solid fuels in lean-mixture combustion modes. However, the combination is even more important for rich mixtures of liquid and solid fuels that would otherwise induce flame instability. The inlet nozzle and plasma torch combination provides low power, reliable ignition, and preliminary fuel heating and activation.

A triple helical flow vortex reactor has shown great advantages while operating as a powerplant employing an equivalence ratio less than 1 and when operating as a fuel reformer employing an equivalence ratio greater than one.

The equivalence ratio is the actual fuel to air ratio in the reaction chamber compared to the stoichiometric fuel to air ratio. Stoichiometric combustion occurs when all the oxygen is consumed in the reaction and there is no molecular oxygen in the combustion products. If the equivalence ratio is equal to one, the combustion is stoichiometric. If it is less than 1, the combustion is lean with excess oxygen, and if it is greater than 1, the combustion is rich with incomplete combustion.

Testing of the original triple helical flow vortex reactor operating on rich mixtures, that is mixtures having an equivalence ratio more than 1, and having less than a stoichiometric quantity of oxidizer, showed significant extension of the reaction zone—by the factor of 4 and up, depending on the reagents.

However, it became apparent that if improvements could be implemented to create a shorter reaction zone, then that would enable the creation of portable fuel reformers and other devices with rich mixture processing.

Accordingly, the present invention will serve to improve the state of the art by enabling the creation of more portable reactors and by providing higher efficiency in combustion using lean mixtures, which stem from colder reaction chamber walls, improved mixing of fuel and reagents; broader flammability limits; and added simplicity and reliability of ignition and flame control in both lean and rich mixtures.

BRIEF SUMMARY OF THE INVENTION

Improvements to a triple helical flow vortex reactor add an inner wall having at least one transition point between the fuel inlet end and the gas outlet end. The transition point marks where the inner wall begins a narrowing of the reaction chamber from a larger fuel inlet end to a narrower gas outlet end. The improvements add a circumferential flow apparatus operating at each transition point to create a circumferential fluid flow transition vortex at the periphery of the reaction chamber. The transition vortex spirals away from the apparatus towards the fuel inlet end in a direction reverse to a fluid flow first vortex created by a fluid feeder or combination fluid feeder and plasma generator. A restrictor at each transition point is optionally added to reduce aerodynamic resistance to the various fluid flows. A vortex swirler is added through the fuel inlet end, which may surround an inlet nozzle combined with a plasma torch. The fuel inlet end is optionally equipped with cooling channels in which a coolant can flow isolated from the reaction chamber. An optional coaxial cylindrical wall extends through the reaction chamber and creates a toroidal volume for reactions.

BRIEF DESCRIPTION OF THE DRAWINGS

Referring now to the drawings in which like reference numbers represent corresponding parts throughout.

DETAILED DESCRIPTION

In the following description, reference is made to the accompanying drawings, which form a part hereof and which illustrate alternative preferred embodiments of the present invention. The drawings and the preferred embodiments of the invention are presented with the understanding that the present invention is susceptible of embodiments in many different forms and, therefore, other embodiments may be utilized and structural and operational changes may be made without departing from the scope of the present invention.

The invention comprises improvements to a triple helical flow vortex reactor having a reaction chamber and more fully described in the '644 and '291 patent applications noted above.

Figure 1:
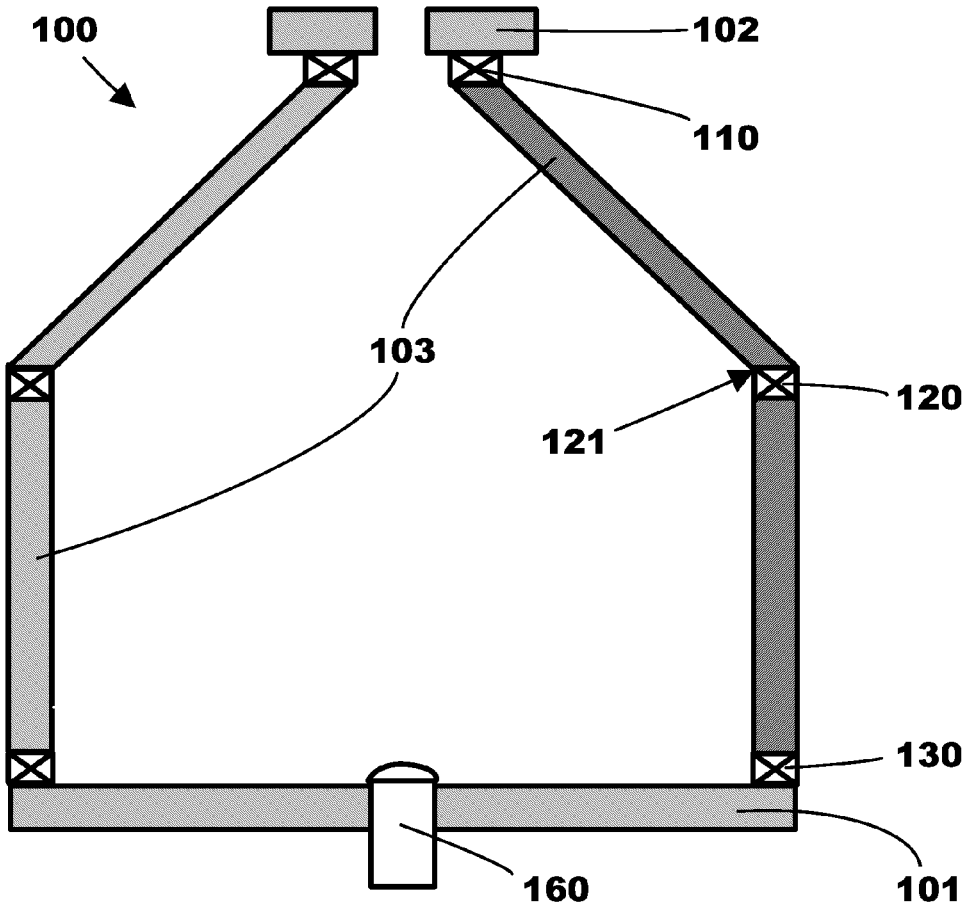
FIG. 1 is a vertical cross-section of a reaction chamber showing in part a circumferential reverse vortex swirler at a stepped inner wall of the reaction chamber in a preferred embodiment in accordance with the invention.

FIG. 1 shows a reaction chamber (100) with a fuel inlet end (101) at the bottom of the drawing and a gas outlet end (102) at the top of the drawing. Thus, fuel inlet end (101) and the gas outlet end (102) are at opposing axial ends of the reaction chamber (100).

Before discussing the improvements, it is necessary for context to note components of a triple helical flow vortex reactor. Reference is made to FIG. 1. The reaction chamber (100) is a primary component having an inner wall (103).

The reaction chamber (100) has a means to for creating a fluid flow first vortex of combusted gases such that the fuel and combusted gases spiral away from a fuel inlet end (101) towards an exhaust nozzle or gas outlet end (102) of the reaction chamber (100). This means for creating a fluid flow first vortex of combusted gases (160) is essentially a fluid feeder or combination fluid feeder and plasma generator.

The reaction chamber (100) has a first circumferential flow apparatus (110) fluidly connected to the reaction chamber (100) at the gas outlet end (102) for creating a circumferential fluid flow second vortex at the periphery of the reaction chamber (100) such that this second vortex spirals away from the first circumferential flow apparatus (110) towards the fuel inlet end (101) in a direction reverse to the fluid flow first vortex.

The reaction chamber (100) has a second circumferential flow apparatus (130) at the fuel inlet end (101) having a fluid connection for creating a circumferential fluid flow third vortex at the periphery of the reaction chamber such that this vortex spirals in a forward direction with the outward flow of combusted gases and creates a mixing region adjacent to the fuel inlet end (101).

A first component of an improvement of the present invention is an inner wall (103) having at least one transition point (121) between the fuel inlet end (101) and the gas outlet end (102) wherein the transition point (121) begins a narrowing of the reaction chamber from a larger fuel inlet end (101) to a narrower gas outlet end (102).

A second component is a circumferential flow apparatus (120) operating at each transition point (121) to create a circumferential fluid flow transition vortex at the periphery of the reaction chamber (100) such that this transition vortex spirals away from the circumferential flow apparatus (120) towards the fuel inlet end (101), which is essentially in a direction reverse to the fluid flow first vortex.

Figure 2:
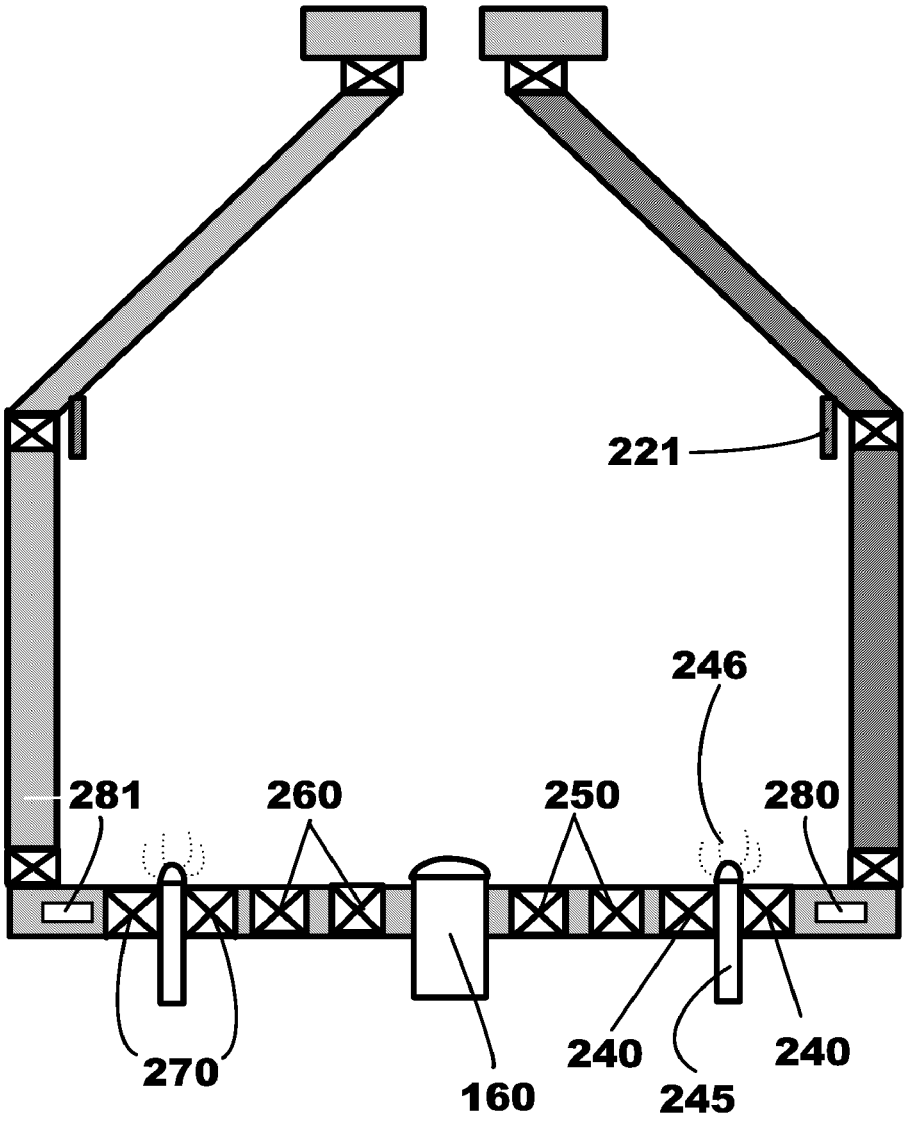
FIG. 2 is a vertical cross-section of a reaction chamber showing in part multiple direct vortex swirlers operating through the fuel inlet end alone and in combination with a inlet nozzle and plasma torch in accordance with the invention.

Another component is a restrictor (221) at each transition point. The restrictor (221) is a physical barrier that tends to prevent the circumferential fluid flow transition vortex created at the transition point from flowing towards the gas outlet end (102). It also tends to separate the circumferential fluid flow transition vortex created at the transition point from any other circumferential fluid flow vortex flowing towards the fuel inlet end (101), such as for example as seen in FIG. 2, the circumferential fluid flow second vortex from the first circumferential flow apparatus (110). Finally, the restrictor tends to reduce noise and drag among interacting vortex flows. An overall impact of a resistor (102) is to reduce aerodynamic resistance to the various fluid flows.

Another component is a vortex swirler (250) through the fuel inlet end (101). FIG. 2 shows four vortex swirlers (240, 250, 260 and 270), which may be described as a micro-swirlers in comparison to, for example, the first circumferential flow apparatus (110). For clarity, both sides of the shown vortex swirlers (240, 250, 260 and 270) on the fuel inlet end (101) are designated with a single number, and it should be recognized that the two sides represent a single circular vortex swirler shown in cross-section. In preferred embodiments, one or more such vortex swirlers may be added through the fuel inlet end (101). Each such micro-swirler operates to create a micro-vortex over a small segment of the fuel inlet end (101).

Another component is one or more inlet nozzles combined with a plasma torch (245) through the fuel inlet end (101). Each inlet nozzle combined with a plasma torch (245) is a combination fluid feeder and plasma generator, as was described in the '644 and '291 patent applications. It performs two functions. It sprays or atomizes a reagent in the combustion chamber (246) and the plasma torch maintains an ignition source in the presence of mixing conditions that otherwise tend to extinguish the ignition source.

Surrounding the inlet nozzle combined with a plasma torch (245) with a vortex swirler (240) increases mixing at the fuel inlet end (101), supplementing the first vortex fluid flow and establishing a multiple micro recirculation zone. Multiple vortex swirlers provide micro vortexes in a combustion zone near the fuel inlet end (101) for better mixing and the residence time extension. While it is preferable to place each inlet nozzle combined with a plasma torch (245) inside a vortex swirler, if fuel flow is low some vortex swirlers, such as (250 and 260) may operate without an inlet nozzle combined with a plasma torch (245).

Another component is a fuel inlet end having cooling channels (280 and 281) in which a coolant can flow isolated from the reaction chamber. Coolant running through the cooling channels keeps the reaction chamber walls cool and increases the operating efficiency of the reactor. In addition to water and other traditional coolants, an isolated flow permits fuel and other reagents to be utilized as a coolant.

It is noted that the reaction chamber wall configuration may take any shape. As examples, the shape optionally be stepped with 90 degree steps as shown in FIG. 3, conical, combined conical and cylindrical, conical and ovate as shown in FIG. 5, conical and ellipse, and cylindrical and round.

Figure 3:
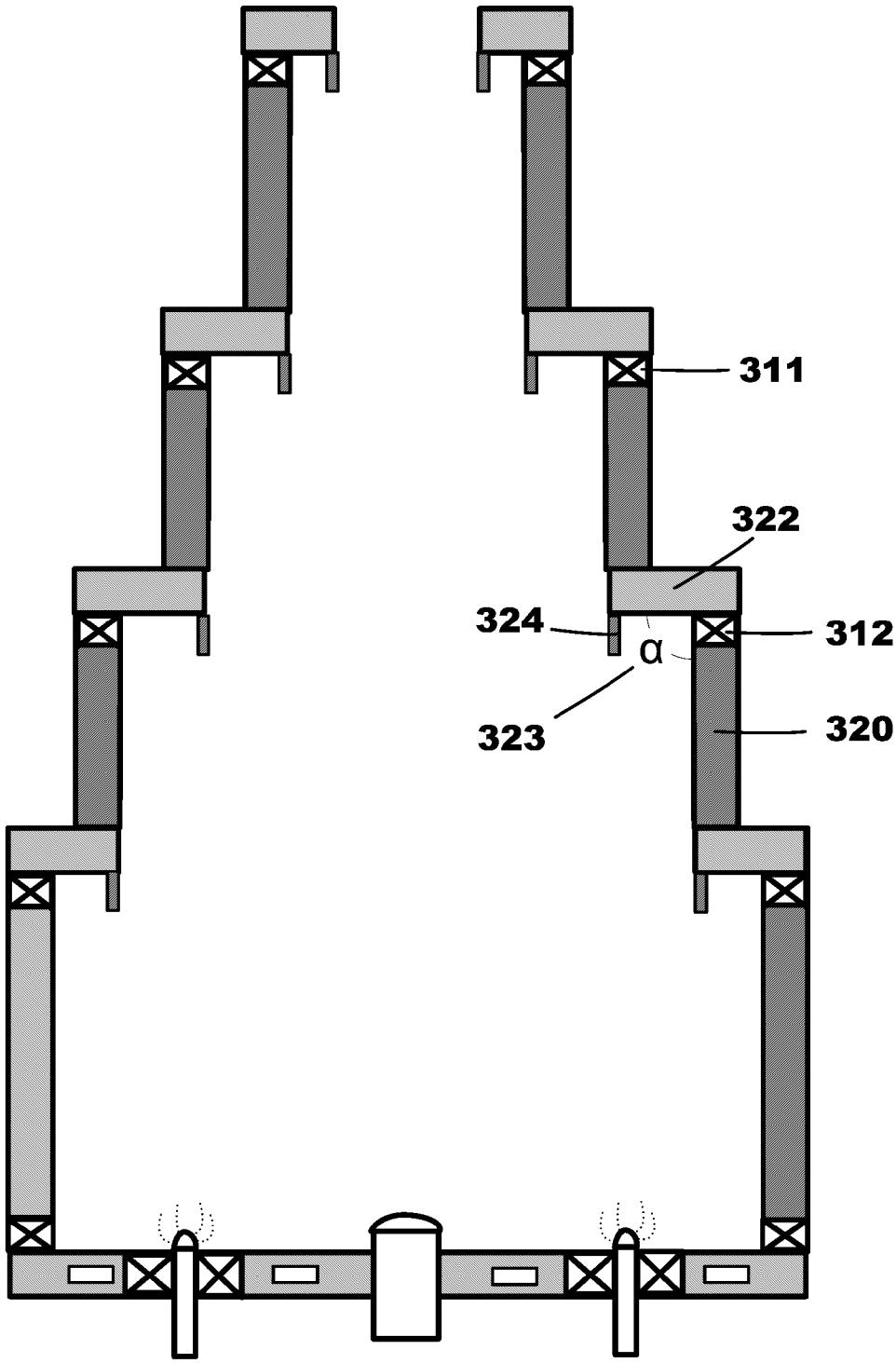
FIG. 3 is a vertical cross-section of a reaction chamber in part showing a stepped inner wall of the reaction chamber with multiple transition points in an alternative preferred embodiment in accordance with the invention.

FIG. 3 shows a reaction chamber with a 90 degree stepped configuration. The angle (323), designated $\alpha$ in FIG. 3, between the riser (320) and the step (322) may vary and the angle between two such neighbor surfaces might any angle greater than zero and less than 180 degrees. For each such angle (323), adding a restrictor (324) is preferable. The step (322) and restrictor (324) acts as a physical barrier that tends to prevent the circumferential fluid flow transition vortex created at the transition point at the junction of the circumferential fluid flow apparatus (312) and the step (322) from flowing towards the gas outlet end (102). It also tends to separate the circumferential fluid flow transition vortex created at that transition point from any other circumferential fluid flow vortex flowing towards the fuel inlet end, such as that flowing from circumferential fluid flow apparatus (311) next nearer to the gas outlet end.

Figure 4:
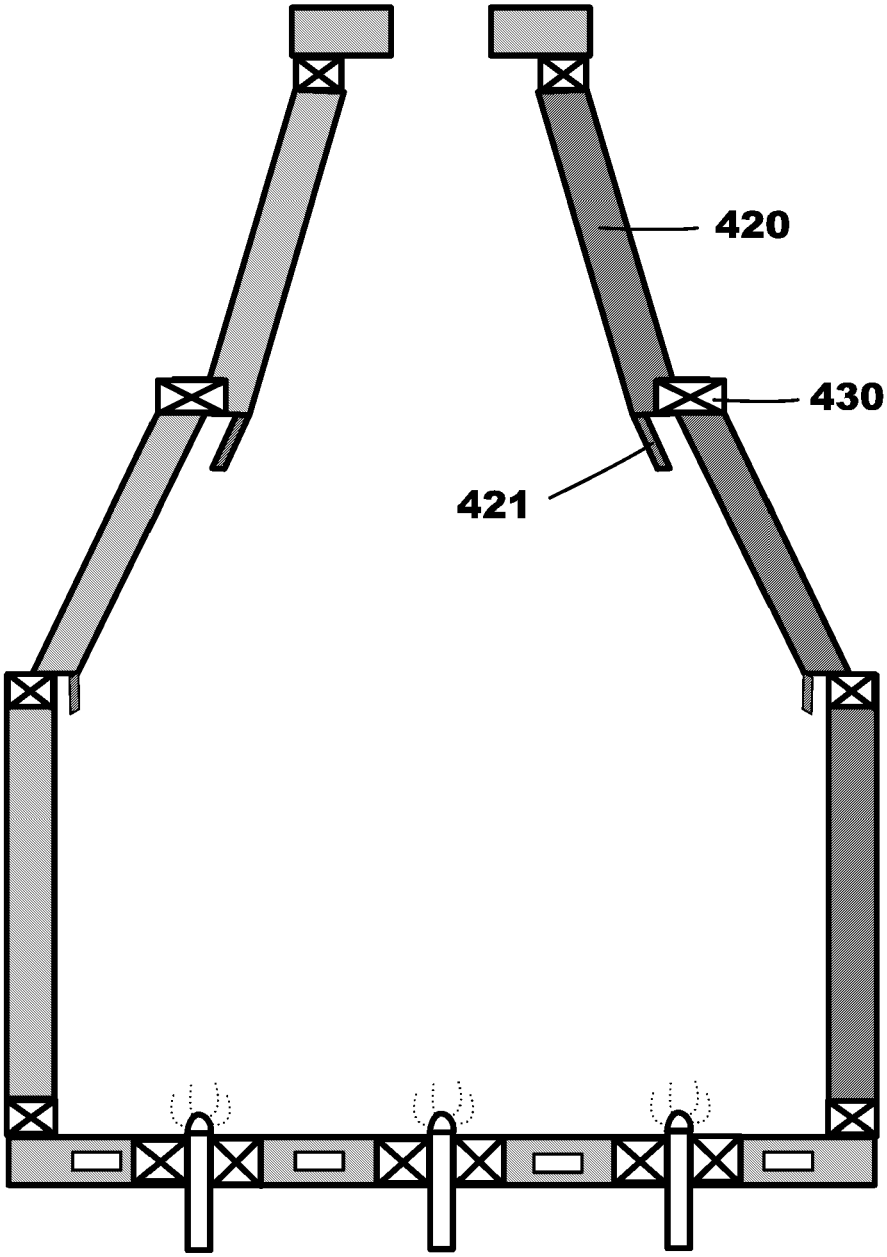
FIG. 4 is a vertical cross-section of a reaction chamber in part showing a stepped inner wall of the reaction chamber with restrictors in another alternative preferred embodiment in accordance with the invention.

FIG. 4 shows another stepped configuration where the restrictor (421) extends downward from a slanted inner wall (420) at a circumferential fluid flow apparatus (430).

Figure 5:
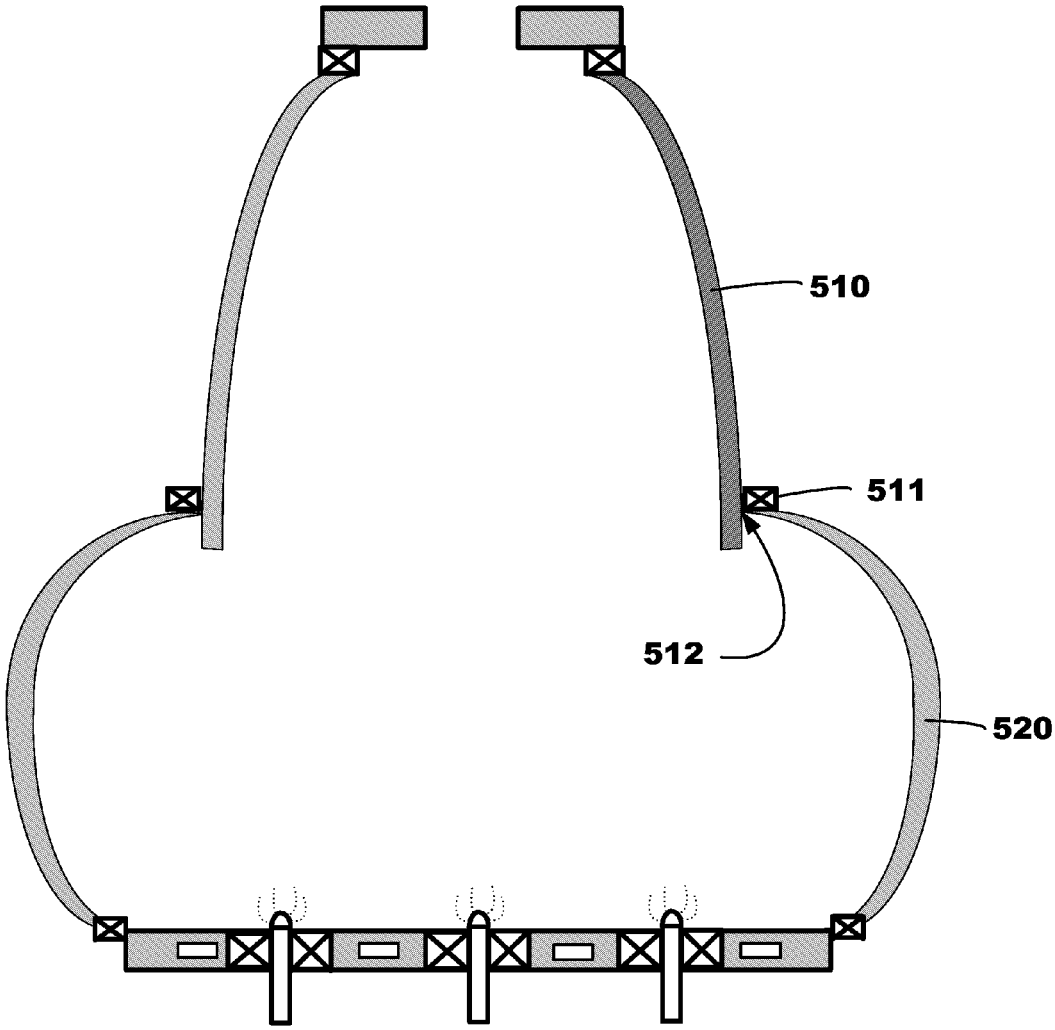
FIG. 5 is a vertical cross-section of a reaction chamber in part showing an ovate combination inner wall segment in another alternative preferred embodiment in accordance with the invention.

FIG. 5 shows another stepped configuration where conical inner wall segment (510) extends below the transition point (512) with ovate inner wall segment (520). A centrifugal fluid flow apparatus (511) is fluidly connected to the reaction chamber at the transition point for creating a circumferential fluid flow vortex at the periphery of the reaction chamber ovate wall segment (520). The ovate inner wall segment (520) creates a larger area near the fuel inlet end and helps to establish a full-scale recirculation zone inside.

Figure 6:
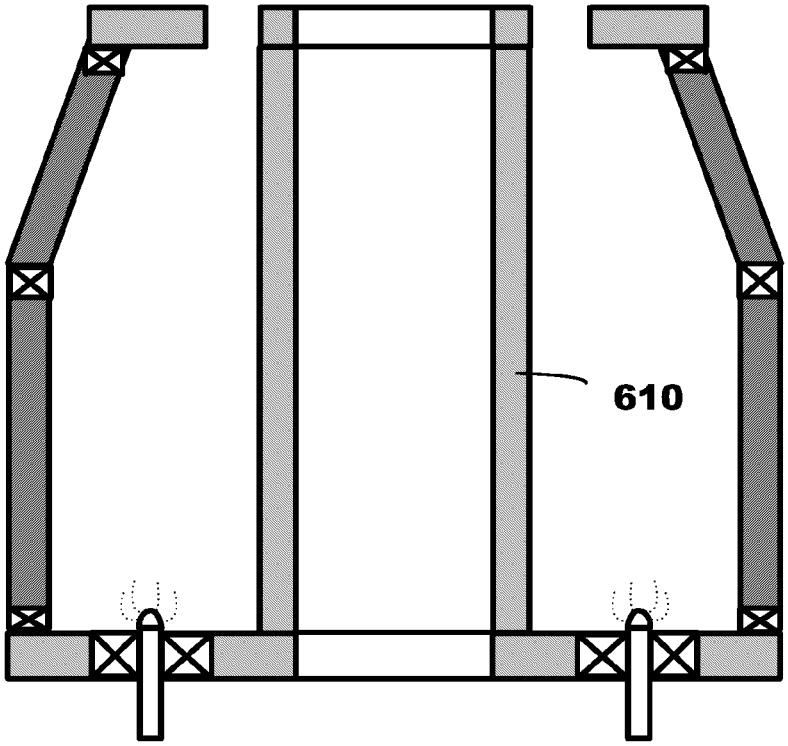
FIG. 6 is a vertical cross-section of a reaction chamber illustrating a stepped configuration wherein the reactions take place in an annular volume within the reaction chamber.

FIG. 6 shows another stepped configuration wherein the reactions take place in an annular volume within the reaction chamber. A coaxial cylindrical wall (610) creates a central exclusion volume within the reaction chamber. This design is applicable to aircraft applications where the exclusion volume is occupied by a shaft. The cylindrical wall, thus, extends through the reaction chamber and creates a donut-shape or toroidal volume for reactions within the reaction chamber.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. An improvement to a triple helical flow vortex reactor with a reaction chamber having a fuel inlet end, a gas outlet end at opposing axial ends of the reaction chamber, and further with an inner wall, means for creating a fluid flow first vortex of combusted gases such that fuel and combusted gases spiral away from a fuel inlet end towards the gas outlet end of the reaction chamber, a first circumferential flow apparatus fluidly connected to the reaction chamber at the gas outlet end for creating a circumferential fluid flow second vortex at the periphery of the reaction chamber such that said second vortex spirals away from said apparatus towards the fuel inlet end in a direction reverse to the fluid flow first vortex, a second circumferential flow apparatus at the fuel inlet end having a fluid connection for creating a circumferential fluid flow third vortex at the periphery of the reaction chamber such that said vortex spirals in a forward direction with the outward flow of combusted gases and creates a mixing region adjacent to the fuel inlet end, wherein the improvement comprises, the inner wall having at least one transition point between the fuel inlet end and the gas outlet end wherein the transition point begins a narrowing of the reaction chamber from a larger fuel inlet end to a narrower gas outlet end; and, a third circumferential flow apparatus operating at each transition point to create a circumferential fluid flow transition vortex at the periphery of the reaction chamber such that said transition vortex spirals away from said apparatus towards the fuel inlet end in a direction reverse to the fluid flow first vortex.

2. The improvement to a triple helical flow vortex reactor of claim 1 further comprising a restrictor at each transition point wherein the restrictor tends to prevent the circumferential fluid flow transition vortex created at the transition point from flowing towards the gas outlet end.

3. The improvement to a triple helical flow vortex reactor of claim 1 further comprising a vortex swirler through the fuel inlet end.

4. The improvement to a triple helical flow vortex reactor of claim 3 wherein the vortex swirler surrounds an inlet nozzle combined with a plasma torch.

5. The improvement to a triple helical flow vortex reactor of claim 1 wherein the fuel inlet end has cooling channels in which a coolant can flow isolated from the reaction chamber.

6. The improvement to a triple helical flow vortex reactor of claim 1 further comprising a coaxial cylindrical wall that extends through the reaction chamber and is configured to creating a toroidal volume for reactions within the reaction chamber.

* * * * *